US008338733B2

(12) United States Patent
Yang et al.

(10) Patent No.: US 8,338,733 B2
(45) **Date of Patent: *Dec. 25, 2012**

(54) SLIDING KEY WITHIN A PORTABLE ELECTRONIC DEVICE

(75) Inventors: Mu-Wen Yang, Taipei Hsien (TW); Chih-Chiang Chang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 727 days.

This patent is subject to a terminal disclaimer.

(21) Appl. No.: 12/538,278

(22) Filed: Aug. 10, 2009

(65) Prior Publication Data

US 2010/0127899 A1 May 27, 2010

(30) Foreign Application Priority Data

Nov. 25, 2008 (CN) ..... 2008 1 0305729

(51) Int. Cl.
*H01H 15/10* (2006.01)

(52) U.S. Cl. ..... 200/547; 361/679.01; 345/158

(58) Field of Classification Search ..... 200/245, 200/252, 295, 537, 547; 361/679.01; 345/158
See application file for complete search history.

(56) References Cited

U.S. PATENT DOCUMENTS

| | | | | |
|---|---|---|---|---|
| 5,969,309 | A * | 10/1999 | Nishimura et al. | 200/16 C |
| 7,898,440 | B2 * | 3/2011 | Chen | 341/22 |
| 8,093,525 | B2 * | 1/2012 | Altmann | 200/537 |
| 8,110,763 | B2 * | 2/2012 | Yang et al. | 200/329 |
| 2001/0007449 | A1 * | 7/2001 | Kobachi et al. | 345/156 |
| 2010/0128460 | A1 * | 5/2010 | Yang et al. | 361/837 |

* cited by examiner

*Primary Examiner* — Vanessa Girardi
(74) *Attorney, Agent, or Firm* — Altis Law Group, Inc.

(57) ABSTRACT

A key assembly comprises a base plate, two elastic elements and a key body. The elastic elements are both mounted to the base plate, and the elastic elements are spaced from and opposite to each other. The key body is slidably mounted to the base plate between the two elastic elements, the key body includes a first key section and a second key section connected with the first key section. The first key section has a first arcuate contacting portion formed thereon, the second key section has a second arcuate contacting portion formed thereon. One of the elastic elements is mounted to the first key section, another one of the elastic elements is mounted to the second key section. When the first key section slides toward and compresses said one of the elastic elements, the second key section slide away from and stretches said another one of the elastic elements.

18 Claims, 7 Drawing Sheets

SLIDING KEY WITHIN A PORTABLE ELECTRONIC DEVICE

This application is related to co-pending U.S. patent application Ser. Nos. 12/538,274, 12/538,277, 12/538,279, entitled "KEY ASSEMBLY AND PORTABLE ELECTRONIC DEVICE USING THE SAME", by Mu-Wen Yang et al. Such applications have the same assignee and inventorship as the present application and have been concurrently filed herewith. The above-identified applications are incorporated herein by reference.

BACKGROUND

1. Technical Field

The exemplary disclosure generally relates to key assemblies, and particularly to key assemblies used in portable electronic devices.

2. Description of Related Art

With the development of smaller and lighter electronic devices for portable use, key assemblies become more compact with individual keys more tightly spaced. Unfortunately, users of these portable electronics devices sometimes experience difficulty in activating keys that are close together; multiple and/or erroneous keys may be activated at the same time. This drawback exists not only in cellular telephones, but other portable electronic devices with key assemblies.

Therefore, there is room for improvement within the art.

BRIEF DESCRIPTION OF THE DRAWINGS

Many aspects of the exemplary embodiments can be better understood with references to the following drawings. The components in the drawings are not necessarily drawn to scale, the emphasis instead being placed upon clearly illustrating the principles of the exemplary key assembly and portable electronic device using key assembly. Moreover, in the drawings like reference numerals designate corresponding parts throughout the several views. Wherever possible, the same reference numbers are used throughout the drawings to refer to the same or like elements of an exemplary embodiment.

DETAILED DESCRIPTION

Figure 1:
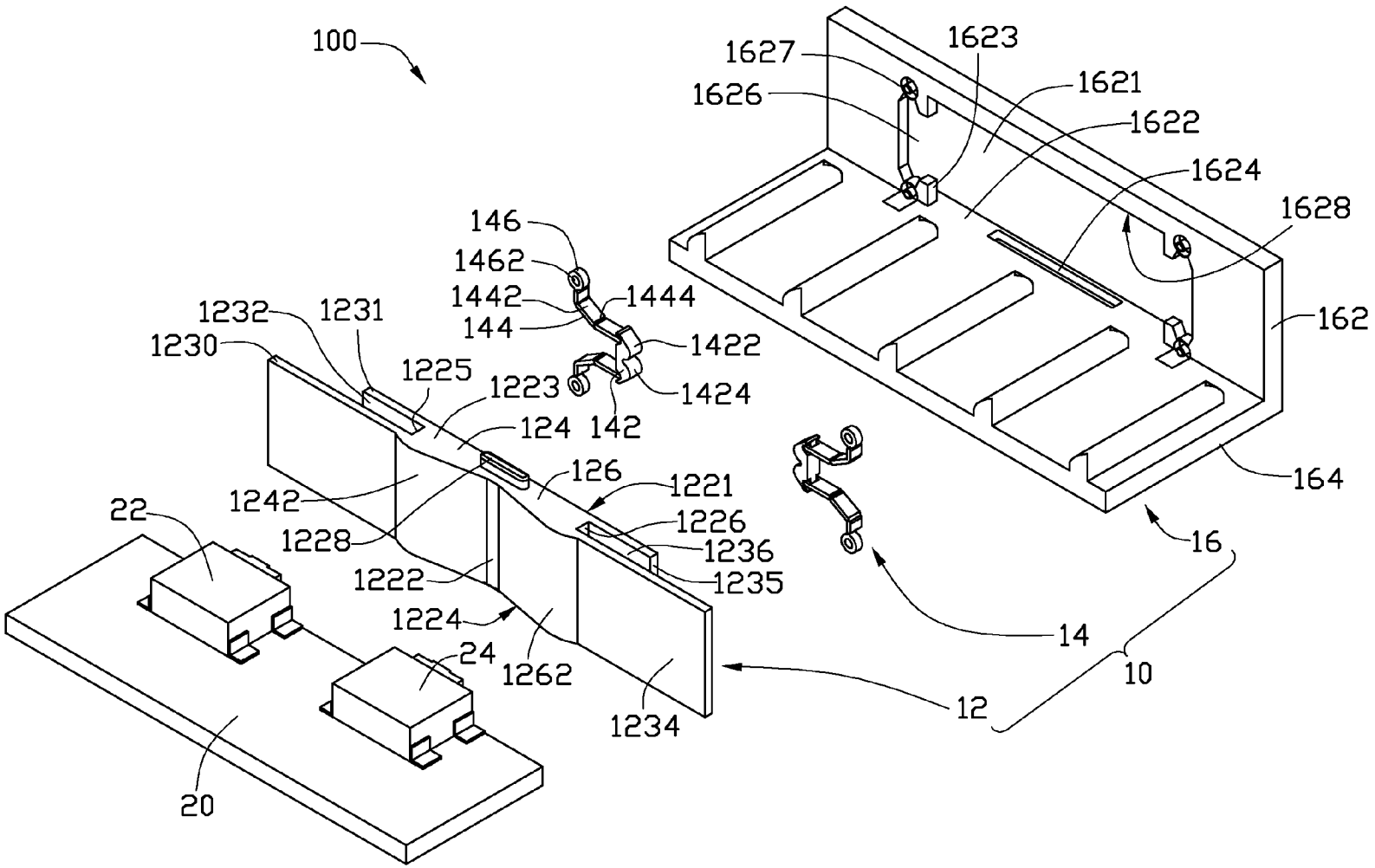
FIG. 1 is an exploded view of one exemplary embodiment of a key assembly used in a portable electronic device, the portable electronic device including the key assembly, a housing, and a circuit board.
Figure 2:
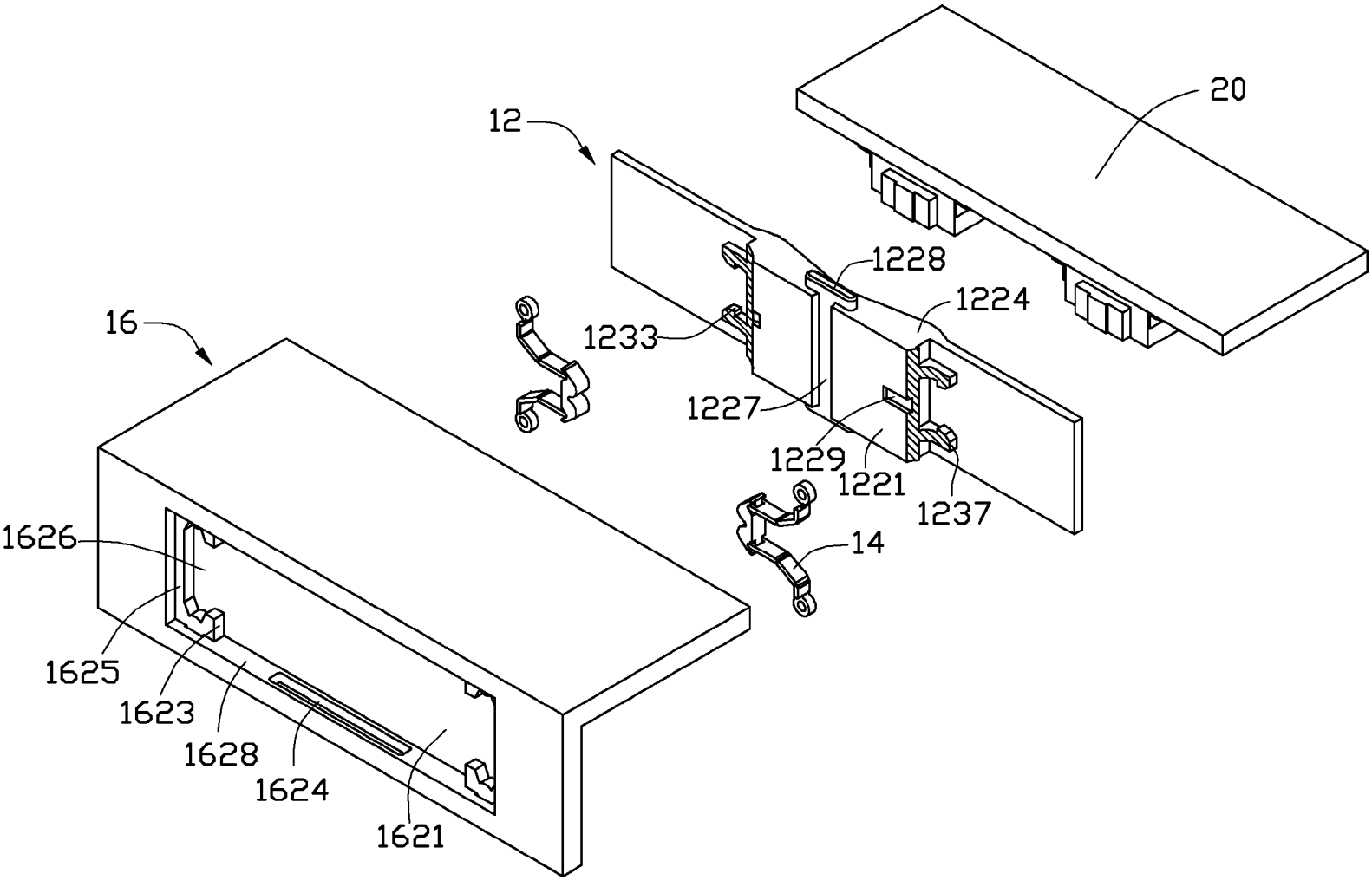
FIG. 2 is similar to FIG. 1, but showing the portable electronic device in another aspect.

Referring to FIGS. 1 and 2, an exemplary embodiment of a key assembly 10 can be used on a portable electronic device 100, such as a cellular phone or any electronic device where a key is desirable. The portable electronic device 100 includes a key assembly 10 and a circuit board 20. The circuit board 20 has a first switch 22 and a second switch 24 spaced from the first switch 22. The key assembly 10 is configured to press the first switch 22 and the second switch 24, to control the circuit board 20.

The key assembly 10 includes a key body 12, two elastic elements 14 and a base plate 16. The key body 12 and the elastic elements 14 are both mounted to the base plate 16. The base plate 16 may be a portion of the housing of the portable electronic device 100 or may be a separate element mounted to the housing of the portable electronic device 100. In this exemplary embodiment, the base plate 16 is a portion of the housing of the portable electronic device 100.

The key body 12 includes an operating surface 1221 facing the outside of the portable electronic device, a contacting surface 1222 opposite to the operating surface 1221, a first side surface 1223, a second side surface 1224 opposite to the first side surface 1223, a first end 1225 and a second end 1226 opposite to the first end 1225. The operating surface 1221 has a trough 1227 transversely defined near a center thereof, thus the key body 12 is divided into a first key section 124 located one side of the trough 1227 and a second key section 126 located another side of the trough 1227. The first key section 124 corresponds to the first switch 22, the second key section 126 corresponds to the second switch 24. The key body 12 further has two guiding blocks 1228 protruding from the first side surface 1223 and the second side surface 1224, respectively. The guiding blocks 1228 are coaxial and are slidably assembled to the base plate 16.

The operating surface 1221 has indicia 1229 respectively defined in the first key section 124 and the second key section 126, to indicate the function of the first key section 124 and the second key section 126. The indicia 1229 of the first key section 124 may be a "–", to indicating the function of the second key section 126 is decreasing volume. The indicia 1229 of the second key section 126 may be a "+", to indicate the function of the first key section 124 is increasing volume.

The key body 12 has a first arcuate contacting portion 1242 protruding from the contacting surface 1222 at the first key section 124. The first contacting portion 1242 corresponds to and is configured to trigger the first switch 22. The key body 12 has a second arcuate contacting portion 1262 protruding from the contacting surface 1222 at the second key section 126. The second contacting portion 1262 corresponds to and is configured to trigger the second switch 24. The first contacting portion 1242 and the second contacting portion 1262 may be constructed from an injection-molded thermoplastic elastomer and configured to produce a point contact sensation in a user's fingertip to provide tactile feedback when a user presses the key body 12.

The key body 12 has a first securing section 1230 and a second securing section 1231 protruding outwardly from the first end 1225 thereof. The first securing section 1230 is spaced from and parallel to the second securing section 1231, so a first securing space 1232 is formed between the first securing section 1230 and the second securing section 1231. The first securing section 1230 is made of flexible material (e.g., thermoplastic elastomer), to facilitate assembling the key body 12 to the base plate 16. The key body 12 has a first latching portion 1233 in the form of two first hooks protruding from the first end 1225 opposite to each other. The first latching portion is configured to latching with one of the elastic elements 14.

The key body 12 has a third securing section 1234 and a fourth securing section 1235 protruding outwardly from the second end 1226 thereof. The third securing section 1233 is spaced from and parallel to the fourth securing section 1234, so a second securing space 1236 is formed between the third securing section 1233 and the fourth securing section 1234.

The third securing section 1233 is made of flexible material (e.g., thermoplastic elastomer), to facilitate assembling the key body 12 to the base plate 16. The key body 12 has a second latching portion in the form of two second hooks 1237 protruding from the second end 1226 opposite to each other. The latching portion is configured to latching with another elastic element 14.

Each elastic element 14 includes a securing portion 142, two spaced compressing portions 144 and two retaining portions 146. The securing portions 142 terminates at one end with a pair of radially-inwardly sloping planes 1422, 1424 that are sized and configured to be matable with the first latching portion and the second latching portion of the key body 12. The compressing portions 144 extend outwardly at the end of the securing portion 142 opposite to the sloping planes 1422, 1424. The distance between the compressing portions 144 gradually increases from the end near the securing portion 142 to the distal ends thereof. Each compressing portion 144 includes a plurality of resilient plates 1442, and two symmetrical slots 1444 transversely defined between two nearest resilient plates 1442. The role of the slots 1444 are to facilitate one resilient plate 1442 bending relative to the nearest resilient plate 1442, thus elasticity of the compressing portions 144 are improved. Each retaining portions 146 is respectively formed at a distal end of each compressing portion 144. Each retaining portion 146 has a retaining hole 1462 defined therethrough. The retaining hole 1462 is configured to mate with the base plate 16.

The base plate 16 includes a peripheral wall 162 and a bottom wall 164 substantially perpendicularly connected to the peripheral wall 162. The peripheral wall 162 has a hole 1621 defined therein corresponding to the key body 12. The hole 1621 is sized and configured to be engaged with the key body 12. The peripheral wall 162 has a first inner wall 1622, a second inner wall 1628 opposite to the first inner wall 1622 and two third inner walls 1623, all of which are defined in the hole 1621. The first inner wall 1622 is level with the bottom wall 164 and the second inner wall 1628 is parallel to the bottom wall 164. The third inner walls 1623 are opposite to each other, both of which respectively connects the first inner wall 1622 with second inner wall 1628.

The peripheral wall 162 further has two guiding grooves 1624 defined in the first inner wall 1622 and the second inner wall 1628, respectively. The guiding grooves 1624 correspond to and are configured to accommodate the guiding blocks 1228 therein. The peripheral wall 162 further has two receiving grooves 1625 respectively defined in the third inner walls 1623 through an outer surface of the peripheral wall 162. The receiving grooves 1625 are larger than and configured for accommodating the second securing section 1231 and the fourth securing section 1234, correspondingly. Thus, the second securing section 1231 and the fourth securing section 1234 can slide in the receiving grooves 1625.

A bottom surface of each guiding groove 1625 has a notch 1626 defined therethrough. The notches 1626 correspond to and are configured to accommodate the compressing portions 144 of the elastic elements 14. The peripheral wall 162 has four retaining poles 1627 protruding from an inner wall thereof corresponding to the retaining holes 1462 of the elastic elements 14. The retaining poles 1627 are retained in the retaining holes 1462, to mount the elastic elements 14 to the peripheral wall 162.

Figure 3:
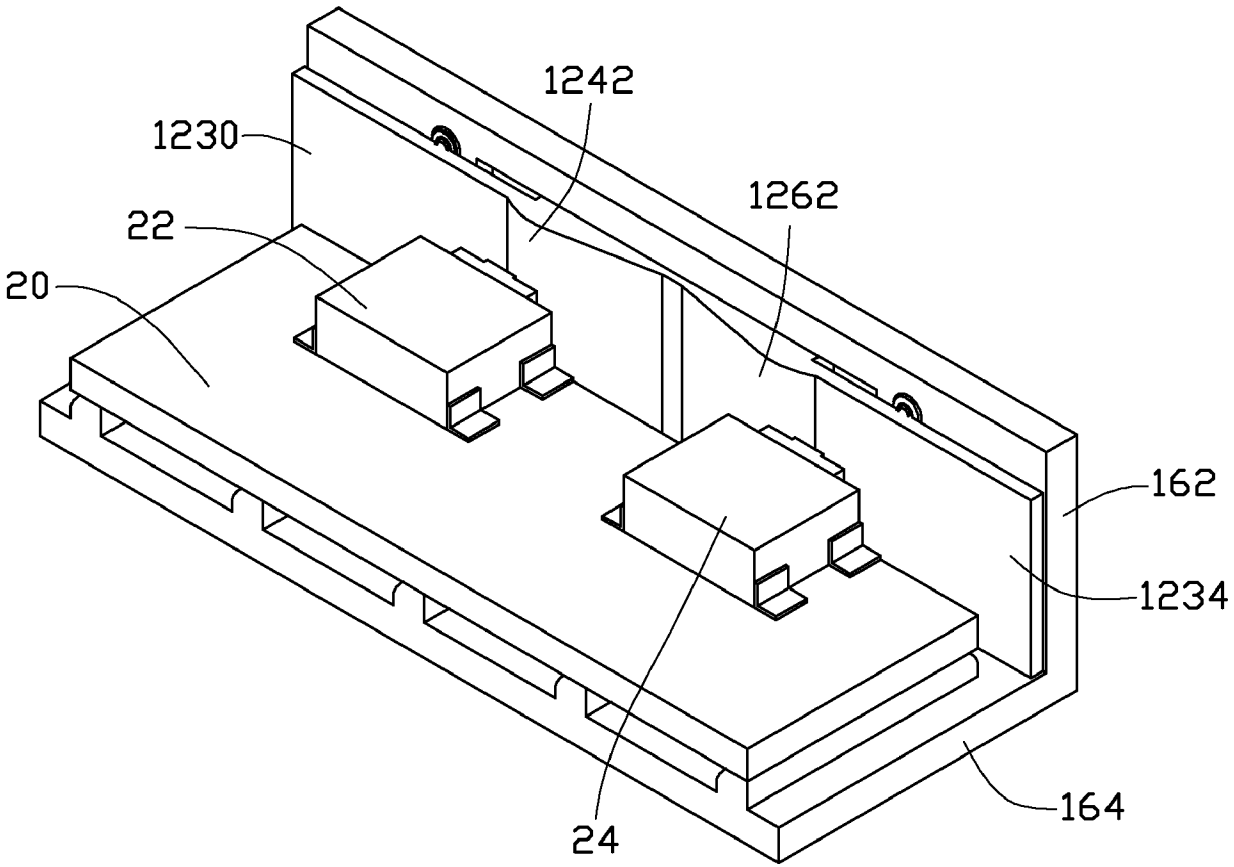
FIG. 3 is an assembled, isometric view of the portable electronic device shown in FIG. 1.
Figure 5:
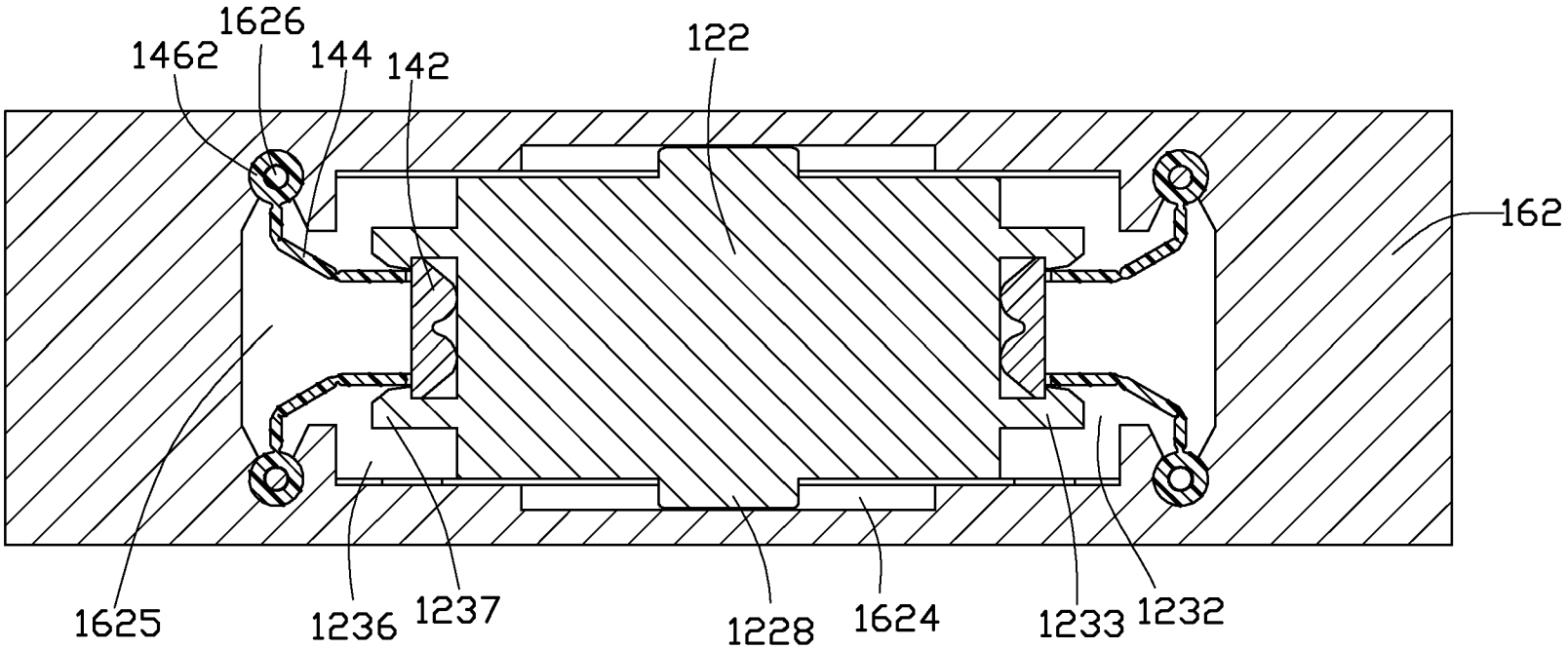
FIG. 5 is a cross-sectional view of the portable electronic device shown in FIG. 3.

Referring to FIGS. 3 and 5, to assemble the portable electronic device 100, Firstly, the securing portions 142 of the elastic elements 14 are respectively latched in the first latching portion 1233 and the second latching portion 1237 of the key body 12, so one end of the elastic elements 14 are secured to the key body 12. Secondly, the first securing section 1230 and the third securing section 1234 are bent to pass through the hole 1621. Thirdly, the guiding blocks 1228 of the key body 12 are accommodated in the guiding grooves 1624 of the base plate 16. At this time, the first securing section 1230 and the third securing section 1234 entirely enter into the base plate 16 and restore to their original state, the first securing space 1232 and the second securing space 1236 respectively accommodate one elastic element 14 therein, the notches 1626 respectively accommodate corresponding compressing portion 144 therein, the second securing section 1231 and the fourth section 1234 are respectively accommodated in corresponding receiving spaces 1265. Thus, the key body 12 is securely mounted to the base plate 16.

Then, the first securing section 1230 and the third securing section 1234 are bent again to exposed the retaining poles 1627 of the peripheral wall 162 and the retaining portions 146 of the elastic elements 14. The retaining poles 1627 are latched in corresponding retaining holes 1462 of retaining portions 146, so that the other end of elastic elements 14 are secured to the base plate 16.

After that, the circuit board 20 is mounted to the bottom wall 164. At this stage, the first switch 22 is resisted against the area of the first contacting portion 1242 where is adjacent to the contacting surface 1222. In other words, the first switch 22 is resisted against the first contacting portion 1242 but don't resist against the high-point of the first contacting portion 1242. The second switch 24 is resisted against the area of the second contacting portion 1262 where is adjacent to the contacting surface 1222. In other words, the second switch 24 is resisted against the second contacting portion 1262 but don't resist against the high-point of the second contacting portion 1262.

Figure 4:
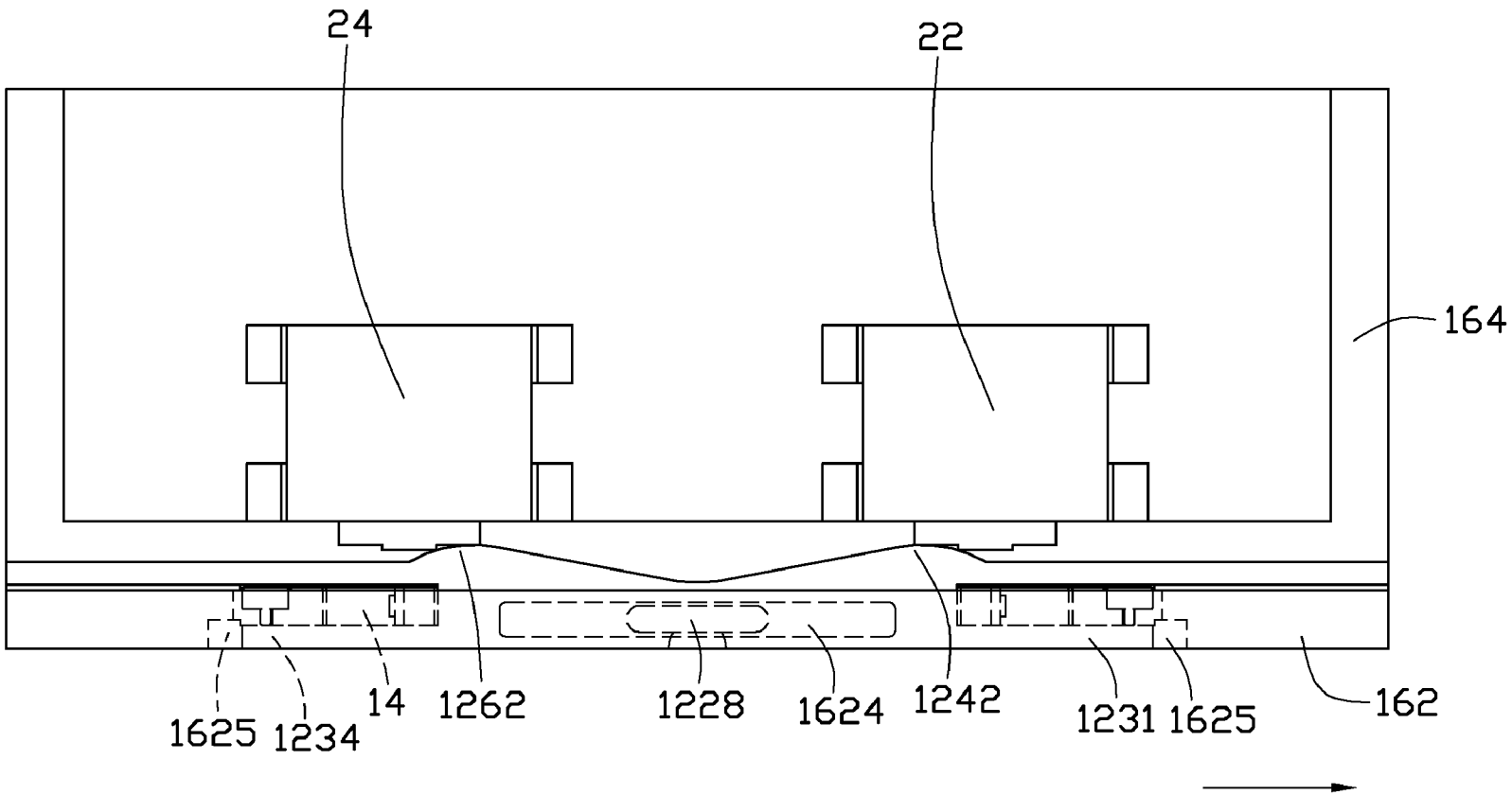
FIG. 4 is a perspective view of the portable electronic device shown in FIG. 3.
Figure 6:
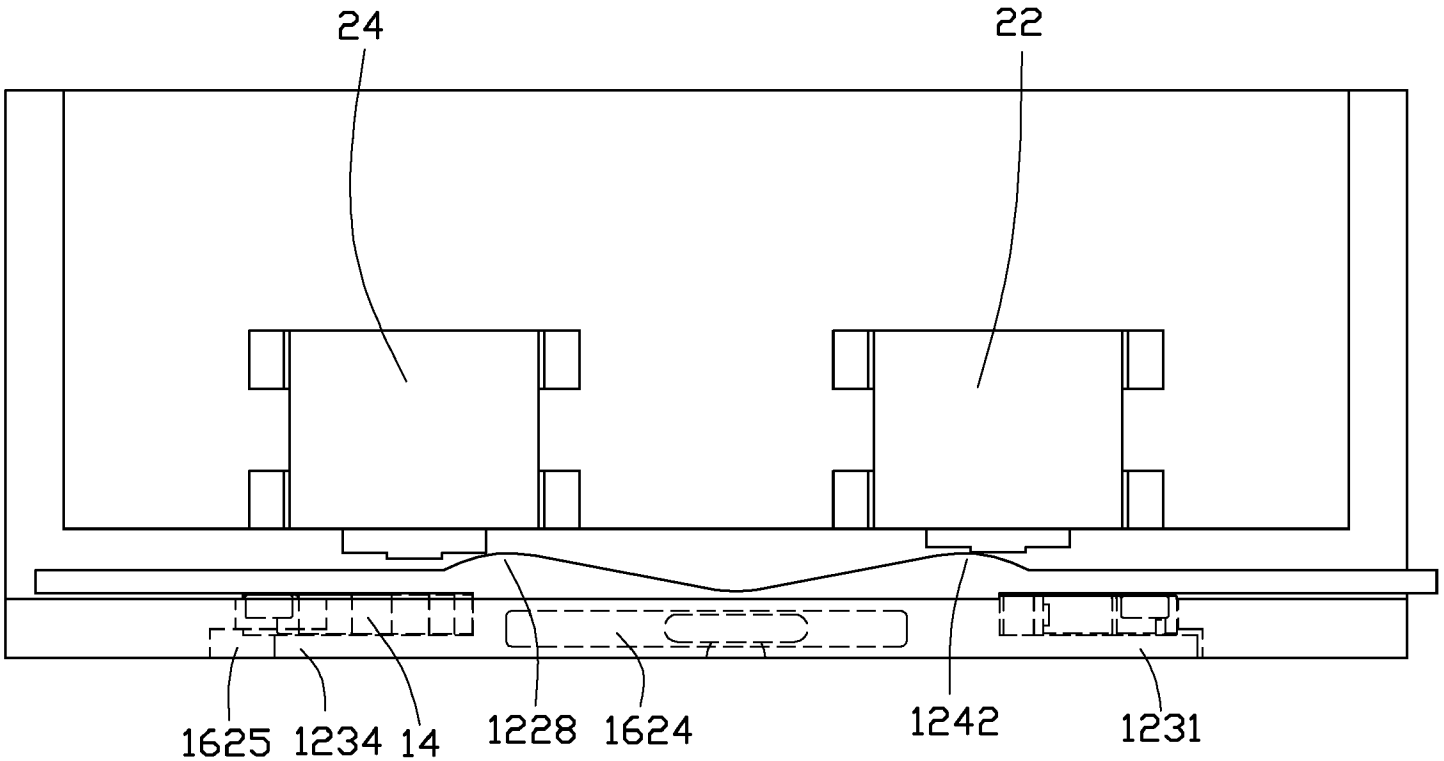
FIG. 6 is similar to FIG. 4, but one key being in pressed state.
Figure 7:
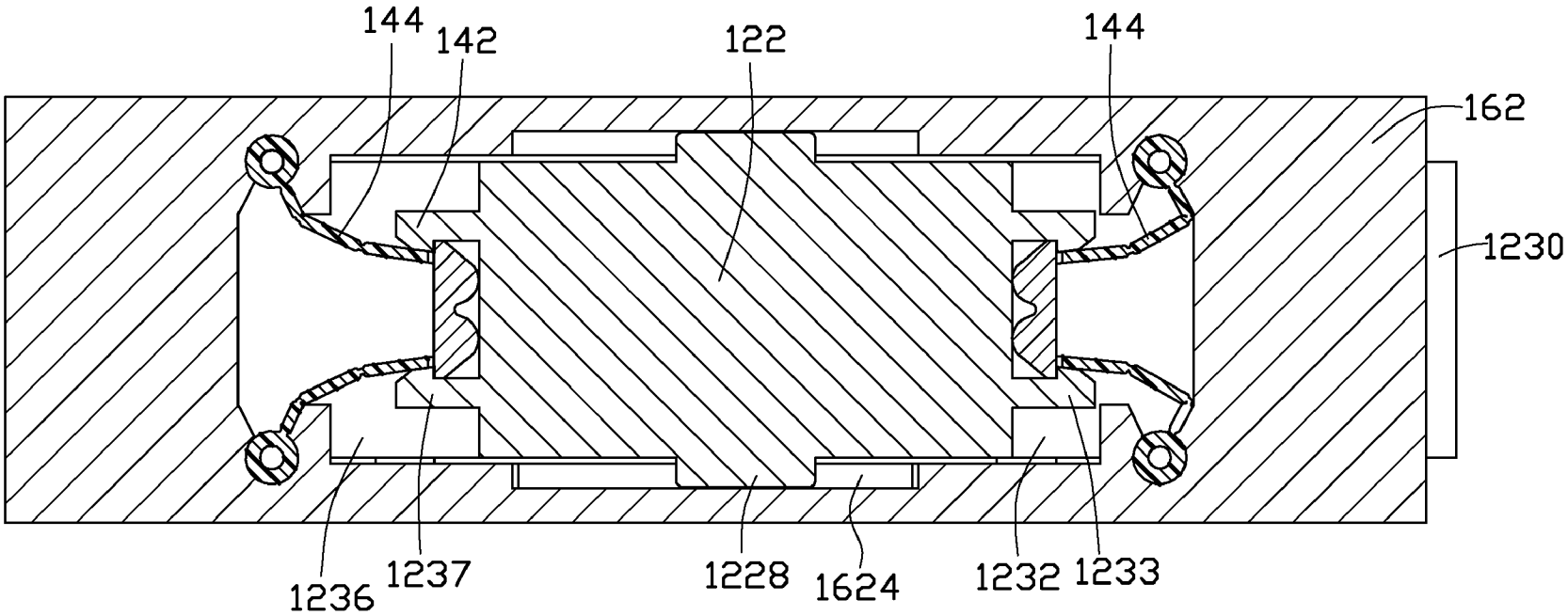
FIG. 7 is a cross-sectional view of the portable electronic device shown in FIG. 6.

Referring further to FIGS. 6 and 7, the use of the key assembly 10 will be described relative to first key section 124. However, such action equally applies to the second key section 126. Firstly, the first key section 124 is pushed in the direction of arrow shown in FIG. 4, so the key body 12 is slid in the hole 1621 in the direction of arrow shown in FIG. 4. At this time, the guiding blocks 1228 slide in the guiding grooves 1624, the first end 1225 of key body 12 compresses the compressing portion 144 mounted on the first end 1225 to accumulate elastic force, thus the key body 12 can rebound when it is released. The high-point of the first contacting portion 1242 move toward the first switch 22, i.e., the first contacting portion 1242 presses and triggers the first switch 22 in the direction of the arrow shown in FIG. 6. Simultaneously, the second key section 126 moves in the direction of arrow shown in FIG. 4, i.e., the high-point of the second contacting portion 1262 moves away from the second switch 24, to prevent triggering the second switch 24. Thus, a user's fingertip touches only one key section at a time, thus removing the possibility of hitting two keys simultaneously. Moreover, the second key section 126 stretches the elastic element 14 mounted thereon to accumulate elastic force, so the key body 12 can rebound quickly when it is released.

It is to be understood, however, that even though numerous characteristics and advantages of the exemplary disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A key assembly comprising:

a base plate;

two elastic elements, the elastic elements being both mounted to the base plate, and the elastic elements being spaced from and opposite to each other, each elastic element including a securing portion; and a key body, the key body slidably mounted to the base plate between the two elastic elements, the key body including a first key section, a second key section connected with the first key section, and two latching portions respectively protruding from the first key section and the second key section, each latching portion being defined by two opposite hooks, the first key section having a first arcuate contacting portion formed thereon, the second key section having a second arcuate contacting portion formed thereon;

wherein the securing portion of one of the elastic elements is mounted to the latching portion of the first key section, the securing portion of the other one of the elastic elements is mounted to the latching portion of the second key section, when the first key section slides toward and compresses said one of the elastic elements, the second key section slides away from and stretches said another one of the elastic elements.

2. The key assembly of claim 1, wherein the key body further comprises a first end, an opposite second, a first securing section protruding outwardly from the first end, a second securing section protruding outwardly from the first end, a third securing section protruding outwardly from the second end, and a fourth securing section protruding outwardly from the second end, the first securing section is spaced from and parallel to the second securing section thereby forming a first securing space to receive one of the elastic elements; the third securing section is spaced from and parallel to the fourth securing section thereby forming a second securing space to receive the other of the elastic elements.

3. The key assembly of claim 1, wherein the key body has two guiding blocks respectively protruding from two opposite side surface thereof, the base plate has two guiding grooves defined therein corresponding to the guiding blocks, the guiding blocks are slidably accommodated in the guiding grooves.

4. The key assembly of claim 3, wherein the base plate has a hole defined therein, the hole is configured for accommodated the key body therein, the guiding grooves are respectively defined in two opposite inner walls in the hole.

5. The key assembly of claim 1, wherein each securing portion terminates at one end with a pair of radially-inwardly sloping planes that are sized and configured to be matable with the latching portions of the key body.

6. The key assembly of claim 5, wherein each elastic element further includes two spaced compressing portions, the compressing portions extend outwardly at the end of the securing portion opposite to the sloping planes, the distance between the compressing portions gradually increases from the end near the securing portion to the distal ends thereof.

7. The key assembly of claim 6, wherein each compressing portion includes a plurality of resilient plates, and two symmetrical slots transversely defined between two nearest resilient plates.

8. The key assembly of claim 6, wherein each elastic element further includes two retaining portions, the retaining portions are respectively formed at a distal end of each compressing portion, the retaining portions are mounted to the base plate.

9. The key assembly of claim 8, wherein each retaining portion has a retaining hole defined therethrough, the base plate has a plurality of retaining poles corresponding to the retaining holes, the retaining poles are retained in the retaining holes to mount the retaining portions to the base plate.

10. A portable electronic device comprising:

a circuit board, the circuit board has a first switch and a second switch mounted thereon; and a key assembly comprising:

a base plate;

two elastic elements, the elastic elements being both mounted to the base plate, and the elastic elements being spaced from and opposite to each other, each elastic element including a securing portion; and a key body, the key body slidably mounted to the base plate between the two elastic elements, the key body including a first key section, a second key section connected with the first key section, and two latching portions respectively protruding from the first key section and the second key section, each latching portion being defined by two opposite hooks, the first key section having a first arcuate contacting portion formed thereon, the second key section having a second arcuate contacting portion formed thereon;

wherein the securing portion of one of the elastic elements is mounted to the latching portion of the first key section, the securing portion of the other one of the elastic elements is mounted to the latching portion of the second key section, when the first key section slides toward and compresses said one of the elastic elements, to allow the first arcuate contacting portion to press the first switch for triggering the first switch, the second key section slides away from and stretches the other one of the elastic elements, to cause the second arcuate contacting portion to move away from the second switch to prevent triggering the second switch.

11. The portable electronic device of claim 10, wherein the key body further comprises a first end, an opposite second, a first securing section protruding outwardly from the first end, a second securing section protruding outwardly from the first end, a third securing section protruding outwardly from the second end, and a fourth securing section protruding outwardly from the second end, the first securing section is spaced from and parallel to the second securing section thereby forming a first securing space to receive one of the elastic elements; the third securing section is spaced from and parallel to the fourth securing section thereby forming a second securing space to receive the other of the elastic elements.

12. The portable electronic device of claim 10, wherein the key body has two guiding blocks respectively protruding from two opposite side surface thereof, the base plate has two guiding grooves defined therein corresponding to the guiding blocks, the guiding blocks are slidably accommodated in the guiding grooves.

13. The portable electronic device of claim 12, wherein the base plate has a hole defined therein, the hole is configured for accommodated the key body therein, the guiding grooves are respectively defined in two opposite inner walls in the hole.

14. The portable electronic device of claim 10, wherein each securing portion terminates at one end with a pair of radially-inwardly sloping planes that are sized and configured to be matable with the latching portions of the key body.

15. The portable electronic device of claim 14, wherein each elastic element further includes two spaced compressing portions, the compressing portions extend outwardly at the end of the securing portion opposite to the sloping planes, the distance between the compressing portions gradually increases from the end near the securing portion to the distal ends thereof.

16. The portable electronic device of claim 15, wherein each compressing portion includes a plurality of resilient plates, and two symmetrical slots transversely defined between two nearest resilient plates.

17. The portable electronic device of claim 15, wherein each elastic element further includes two retaining portions, the retaining portions are respectively formed at a distal end of each compressing portion, the retaining portions are mounted to the base plate.

18. The portable electronic device of claim 17, wherein each retaining portion has a retaining hole defined therethrough, the base plate has a plurality of retaining poles corresponding to the retaining holes, the retaining poles are retained in the retaining holes to mount the retaining portions to the base plate.

* * * * *